US006193440B1

(12) United States Patent
Pidgeon et al.

(10) Patent No.: US 6,193,440 B1
(45) Date of Patent: Feb. 27, 2001

(54) RAILROAD CABLE PLOW APPARATUS

(76) Inventors: Kenneth A. Pidgeon, 13 Vale Dr., Essex Junction, VT (US) 05452; Alan Pidgeon, 64 Landon Rd., South Hero, VT (US) 05486

( * ) Notice: Subject to any disclaimer, the term of this patent is extended or adjusted under 35 U.S.C. 154(b) by 0 days.

(21) Appl. No.: 09/258,519

(22) Filed: Feb. 26, 1999

(51) Int. Cl.[7] ..... F16L 1/00

(52) U.S. Cl. ..... 405/180; 405/154; 405/164; 37/106

(58) Field of Search ..... 405/180, 187, 405/182, 183, 184, 174, 179, 154; 37/104, 105, 106, 443

(56) References Cited

U.S. PATENT DOCUMENTS

| | | | | |
|---|---|---|---|---|
| 572,875 | * | 12/1896 | Doddridge | 37/106 |
| 633,977 | * | 9/1899 | Doddridge | 37/106 |
| 734,615 | * | 7/1903 | Roberts | 405/164 |
| 3,546,887 | | 12/1970 | Helmus | 61/72.1 |
| 3,815,268 | | 6/1974 | Yard | 37/105 |
| 4,038,828 | | 8/1977 | Schuck et al. | 61/72.6 |
| 4,040,261 | | 8/1977 | Schuck et al. | 61/72.6 |
| 4,119,157 | | 10/1978 | Schuck et al. | 172/477 |
| 4,266,351 | * | 5/1981 | Cox | 37/104 |
| 4,720,929 | | 1/1988 | Umberson | 37/91 |
| 4,736,534 | * | 4/1988 | Daniels et al. | 37/104 |
| 4,768,297 | | 9/1988 | Rivard | 37/91 |
| 4,784,524 | | 11/1988 | Stine | 405/174 |
| 4,794,709 | | 1/1989 | Rivard | 37/94 |
| 4,871,127 | | 10/1989 | Clark | 242/86.5 R |
| 4,890,958 | | 1/1990 | Dancer | 405/180 |
| 4,992,000 | * | 2/1991 | Doleshal | 405/164 |
| 5,482,121 | | 1/1996 | Draney et al. | 172/40 |
| 5,490,339 | | 2/1996 | Accettola | 37/94 |
| 5,558,465 | | 9/1996 | Pecot et al. | 405/178 |
| 5,596,822 | | 1/1997 | Desmarais et al. | 37/104 |

* cited by examiner

*Primary Examiner*—Eileen D. Lillis
*Assistant Examiner*—Frederick L. Lagman
(74) *Attorney, Agent, or Firm*—Theodore R. Touw

(57) ABSTRACT

Apparatus for laying underground cable or conduit (such as innerduct) includes a vertical cable plow connected to the boom of an excavator, the excavator being mounted on a first flat-bed rail car, and a second flat-bed rail car following the first for carrying supply reels of cable or conduit fed from the second car to the first. Cable guides guide the cable or conduit from the supply reels to the plowshare and through the plow assembly to the desired subterranean level in a ditch made by the plow. The first and second flat-bed cars are preferably pulled by a pair of conventional diesel-electric locomotives. A rigid element mountable to the first flat-bed rail car and extending outward from either side of the first flat-bed rail car transfers torque on the plowing assembly to the rail car. The rigid element ("boot") is preferably removable to temporarily narrow the apparatus for travel mode. The apparatus may be installed on a flat-bed truck or a canal barge instead of a rail car. The plow blade is readily equipped with a vibratory attachment and/or replaced for specific purposes with a soil trencher, rock chainsaw, wheel rocksaw, or other type of end-effector. A second plow, mounted on a third flat-bed car disposed ahead of the main plow, can be employed to pre-rip the ground ahead of the main plow.

39 Claims, 9 Drawing Sheets

RAILROAD CABLE PLOW APPARATUS

FIELD OF THE INVENTION

This invention relates generally to apparatus for laying cables or conduit and, more particularly, to railroad cable plow apparatus.

BACKGROUND OF THE INVENTION

With increased worldwide demand for telecommunications and networking services and the requisite bandwidth, there has been a continuing and growing need to lay cables and conduit, especially for fiber-optic cables. The rights-of-way along railroad tracks provide existing paths for installation of thousands of kilometers of new cable. Railway track-maintenance equipment for maintaining railroad track rights of way has been known for many years. Cable-laying apparatus including rail plows for plowing a trench alongside railroad tracks has also been known and has been used for laying cable.

U.S. Pat. No. 3,546,887 to Hehnus disclosed an apparatus for burying lineal material adjacent to railroad tracks, utilizing a track-supported mobile base. Rearwardly trailed, elongate beams extend laterally in a positionable manner from a railroad car side and draw a blade element through the ground to form a kerf within which continuous flexible material such as signal or electrical cable is deposited by a cable shoe carried by the blade. Hydraulic components position the beam to adjustably locate the blade for depositing the cable at selected depths and distances from the railroad tracks.

U.S. Pat. No. 3,815,268 to Yard disclosed a ballast regulator control means for controlling the ballast box of a ballast regulator used for positioning or "regulating" ballast on the shoulder of a railroad track. Hydraulic cylinders are provided for adjusting the position of the ballast box around two respective pivotal axes. A cable attached to the outer end of the arm coupled to hoisting means on the vehicle chassis controls the height of the arm.

U.S. Pat. No. 4,038,828 to Schuck et al. disclosed a vertical lift and tilt control for plows for laying cable, pipe and the like underground. A mast assembly has a generally vertical rail, and a slide frame is slidably mounted on the vertical rail. The plow assembly is supported on the slide frame and a power means, such as a piston, is connected to the mast and slide frames for raising and lowering the plow assembly. The mast assembly is pivotally supported on a suitable vehicle and a second power means, such as a piston, is pivotally connected to the vehicle and the mast assembly for adjusting the tilt or attack angle of the plow blade.

U.S. Pat. No. 4,040,261 to Schuck et al. disclosed a vibratory plow suitable for laying cable, pipe and the like underground. The plow blade is pivotally mounted on a frame assembly on a resilient mounting. The frame assembly includes a U-shaped yoke pivotally mounted at opposite ends to the frame assembly. A vibrator is mounted on the yoke and the yoke is pivotally connected to the blade by a link which is pivotally connected at opposed ends to the blade and the yoke. The blade is thereby vibrated in an orbital plowing motion as the blade is drawn through the earth by a suitable vehicle.

U.S. Pat. No. 4,119,157 to Schuck et al. disclosed a control mechanism for adjusting the angle and lateral position of a plow blade which is particularly useful for laying cable, pipe and the like underground. The control mechanism includes a fixed frame, which is supported on a suitable vehicle and a slide frame, which supports the plow blade. The slide frame is slidably supported on a horizontal rail of the fixed frame. A piston or other power means is connected to the fixed and slide frames to adjust the lateral position of the supported plow blade. The plow includes a support frame which is pivotally mounted on a vertical pivot on a slide frame, and the control mechanism includes means to angularly adjust the blade on the pivot.

U.S. Pat. No. 4,720,929 to Umberson disclosed a trenching device in which an improved torsional limiting device and associated control system provide for protection of the equipment components in the event the cutting wheel encounters unforeseen obstructions.

U.S. Pat. No. 4,768,297 to Rivard disclosed a trenching wheel, especially for digging trenches. Tools are mounted on ring portions removably fixed to the periphery of the wheel.

U.S. Pat. No. 4,784,524 to Stine disclosed apparatus for holding the plow blade of a railroad car-mounted cable laying device which includes support means on the railroad car for supporting the plow blade and stop means on the support means for prohibiting the plow blade from sliding off the support means. When more than one plow blade is provided, tethering means is also provided between the plow blades for constraining the plow blades and prohibiting the plow blades from sliding off the support means.

U.S. Pat. No. 4,794,709 to Rivard disclosed a device for digging trenches, including at least one digging wheel with a wheel framework which is connected to a vehicle by means of a mobile carriage for lowering or raising the digging wheel, means for causing the digging wheel to pivot about a first pivoting axis, and means for causing the digging wheel to pivot about a second pivoting axis.

U.S. Pat. No. 4,871,127 to Clark, reissued as RE34488, disclosed a portable device for storing an endless metallic or fiber-optic cable. A portable trailer supports a long horizontal tube on which is mounted a rotatable and reciprocable drum and a fixed storage reel. Rotating and reciprocating the drum neatly winds the cable onto the storage reel from a supply reel, although there is no access to the cable ends.

U.S. Pat. No. 4,890,958 to Dancer disclosed a railroad right-of-way cable/pipe trench-plowing machine which includes a locomotive, standard flat car, a hydraulic boomed vehicle such as a backhoe attached to the flat car, a steerable plowing blade attached to the hydraulic boom, and a cable attached at one end to the plowing blade and the other end to the locomotive. The plowing blade is pivotally attached to the hydraulic boom and has a tooth located at its bottom end foot, which is disposed to point in the direction to be trenched. A cable guide, consisting of a J-shaped tube, is attached to the trailing edge of the vertical blade and is disposed such that a utility cable fed into the top end of the cable guide is automatically directed to the base of the trench. An optional feature provides a hydraulic ram attached between the pivoting blade and the hydraulic boom for hydraulically pivoting the blade about the boom. The hydraulic ram provides additional steering capabilities.

U.S. Pat. No. 5,482,121 to Draney et al. disclosed a vibratory cable plow assembly including a frame assembly for connecting a plow blade to a frame of a prime mover. The frame assembly supports a vibrating mechanism or shaker that is adapted to impart vibratory movements to the plow blade. A lower support mounts a blade supporting frame for rocking movement around a generally horizontal pivot mechanism. The vibratory mechanism is mounted on the blade supporting frame.

U.S. Pat. No. 5,490,339 to Accettola disclosed a centerline trenching system for earth surface use, as on paved streets, roads, highways and the like. The system includes a rubber-tired drive machine for advancing a side-by-side tandem of a earth saw and a conveyor attached to a rear surface of the drive machine.

U.S. Pat. No. 5,558,465 to Pecot et al. disclosed a method and device for laying an underground telecommunications cable. A first drum is positioned stationarily and supplies the cable to a trench that is dug in the ground. A hauling pig is connected to the leading end of the cable. A second drum, mounted to a movable tractor, supplies a tube to the trench and is intended to receive the cable. The tractor also has a plowshare mounted to its forward end for forming the trench as the tractor moves. A compressor, connected to a tube section rearwardly of the pig, propels the leading end of the cable to a predetermined point in a turn of a rolled tube as stored on the second drum. In the event an obstacle is encountered by the tractor, the compressor is interrupted and a length of tube is payed out from the second drum and temporarily remains unoccupied by cable. The payed out length of tube is cut at an end so that the tractor becomes free to move around the obstacle.

U.S. Pat. No. 5,596,822 to Desmarais et al. disclosed a rubber-tired cable-laying apparatus for burying cable in or adjacent to a railway bed. A cable-laying plough is mounted to a rubber-tired loader, and the loader moves forward under its own power while straddling the track. A pair of rail wheels are mounted on the forward and rearward ends of the loader.

The apparatus and methods known for laying cables, pipes, and conduits have no doubt performed well in their intended uses. However, considerations of speed and efficiency have required an improved apparatus for laying cable in railroad rights-of-way, alongside the railroad tracks.

Notations and Nomenclature

In this specification, the term "cable" refers to any elongate article to be installed underground and includes conventional utility cables (for e.g. electric power, telecommunications, data transmission, etc.) including particularly fiber-optic cable; conduits (such as innerduct) through which cables, wires, and fiber-optics are conventionally fed; and marking ribbons or other markers conventionally buried with or near cables to mark their locations and to warn excavators of the presence of the cables. The terms "plowshare" and "plow blade" and "plow" are used as synonyms to refer to the part of a static or vibratory cable plow that is operative for creating a trench, including any cable-guide portion usually secured to the trailing edge of a plow blade for guiding cable into the trench created by the blade and any means for vibrating the blade in conventional vibratory plows, and also including soil trenchers, rock chainsaws, wheel-shaped rock saws, and the like.

Problems Solved the Invention

When a railroad locomotive is pulling a rail plow, resistance and high friction at the plow blade proper cause a torque applied at the plow blade. Such torque tends to rotate the support used to position the plow blade at the desired trench location. In conventional practice, this has often contributed to a limitation of installing cable within two meters or less of the rail. Rail plows of the background art have sometimes included a cable attached at one end to the plowing blade and the other end to the locomotive. But such a cable necessarily extends through the earth ahead of the plowing blade and down through the earth to an attachment point on the plowing blade, increasing friction and resistance and becoming subject to wear. A railroad cable plow apparatus having means for transferring torque to a railroad car while avoiding the disadvantages of such a cable is needed to provide an improved apparatus capable of higher speed and greater overall efficiency than apparatus of the prior art.

OBJECTS AND ADVANTAGES OF THE INVENTION

A major object of the invention is an apparatus for laying cable with improved speed and efficiency. Another object is an apparatus with improved accommodation for torque on a plow apparatus engaged in laying cable. A related object is cable-laying apparatus which avoids the use of a cable or the like extending from a plowing blade to a locomotive or other tractor.

SUMMARY OF THE INVENTION

Apparatus for laying underground cable or conduit (such as innerduct) includes a vertical cable plow attached to the boom of an excavator, the excavator being mounted on a first flat-bed rail car, and a second flat-bed rail car following the first for carrying reels of cable or conduit fed from the second car to the first. Cable guides guide the cable or conduit from the reels to the plow and through the plow assembly to the desired subterranean level in a ditch made by the plow. The first and second flat-bed cars are preferably pulled by a pair of conventional diesel-electric locomotives. A rigid element mountable to the first flat-bed rail car and extending outward from either side of the first flat-bed rail car transfers torque on the plowing assembly to the rail car. The rigid element ("boot") is preferably removable to temporarily narrow the apparatus for travel mode. The apparatus may be installed on a flat-bed truck or on a canal barge instead of a rail car. The plow blade is readily equipped with a vibratory attachment and/or replaced for specific purposes with a soil trencher, rock chainsaw, wheel rocksaw, or other type of end-effector. A second plow, mounted on a third flat-bed car disposed ahead of the main plow, can be employed to pre-rip the ground ahead of the main plow.

DETAILED DESCRIPTION OF THE PREFERRED EMBODIMENTS

Figure 1:
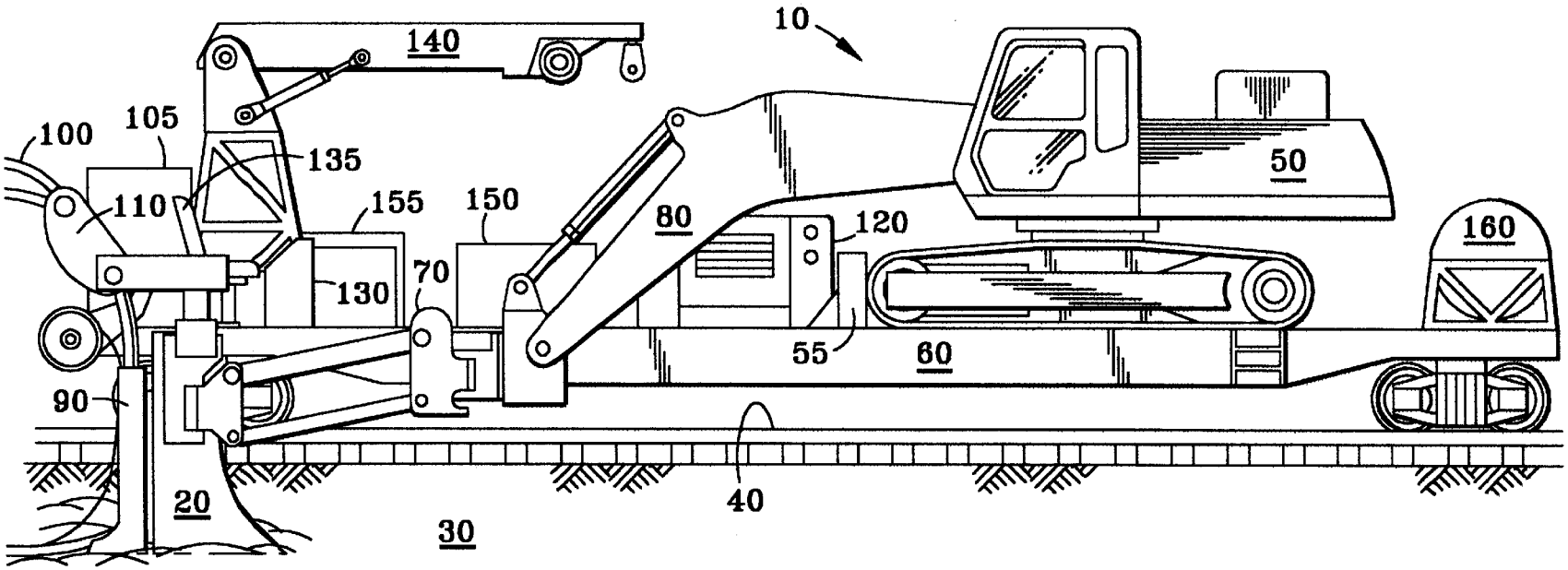
FIG. 1 is a side elevation view of a railroad cable plow apparatus made in accordance with the invention.
Figure 2:
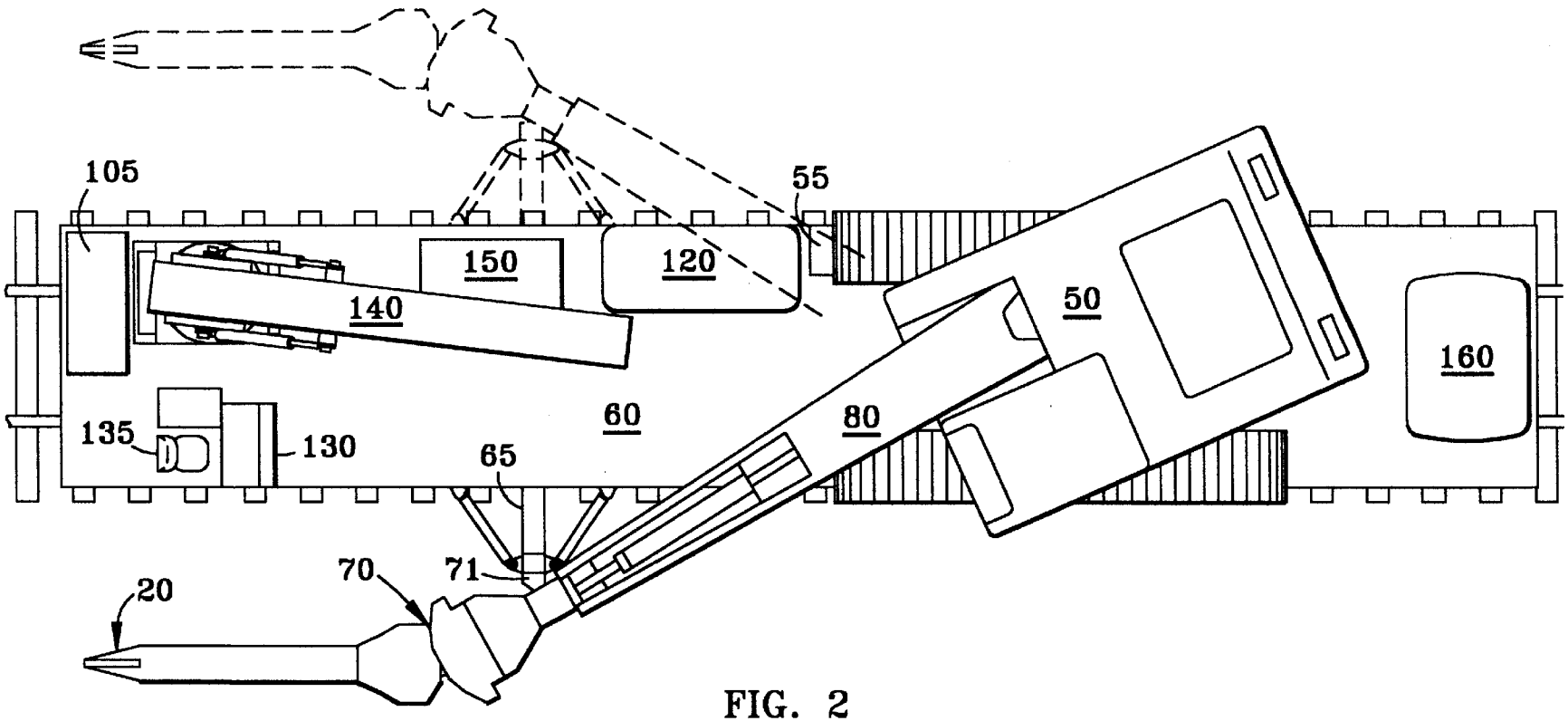
FIG. 2 is a top plan view of a railroad cable plow apparatus made in accordance with the invention.

FIG. 1 is a side elevation view and FIG. 2 is a top plan view of a railroad cable plow apparatus made in accordance with the invention. An apparatus 10 for installing underground a cable 100, conduit, or the like, comprises a flat-bed first vehicle 60, a second vehicle 50 secured to the first vehicle (the second vehicle 50 including a hydraulic boom 80 capable of extending beyond at least one of the lateral edges of the flat-bed first vehicle), a plowshare 20 connected to said hydraulic boom for digging a trench, and means 110 for feeding cable, conduit, or the like to the plowshare. The flat-bed first vehicle 60 is equipped with a rigid element 65 disposed to extend laterally to maintain the plowshare 20 at a distance from the lateral edge of the first vehicle to guide the plowshare to create a trench at the desired location for installing the cable 100.

In the preferred embodiment, the flat-bed first vehicle 60 is a railroad flat car of suitable dimensions, e.g. about 2.44 meters (8 ft.) wide and about 16.5 meters to 20.5 meters (54 ft. to 67 ft.) long, for travel along rails 40. The rail car 60 is preferably reinforced as described below with reference to FIGS. 5 and 7. A counter weight 105 is preferably added to stabilize the rail car during plowing. Handrails are preferably provided for worker safety. A lighting system is provided for viewing the ground and foul areas during nighttime operation. An operator's console 130 and chair 135 are mounted on rail car 60. A workbench or table 155 may be attached to the rail car.

Apparatus 10 for laying cable or conduit such as innerduct includes a generally vertical cable-plow blade or plowshare 20. Plowshare 20 may be, for example, an RWF Bron plow blade of the type available from RWF Industries Division of Roberts Welding and Fabricating Ltd. of Embro, Ontario, Canada, or of the parallel-action type (Model OCPT-D6C) formerly available from American Tractor Equipment Corporation (Ateco) of Oakland, Calif. and sometimes still available as used equipment. The cable-plow blade 20 includes a conventional cable guide preferably secured to the trailing edge of the blade for guiding cable or conduit into a trench created by the blade. Standard installation depth is conventionally about 1.22 meters (4 ft.). The cable-plow blade 20 may be lengthened if needed, e.g. for greater installation depth. Cable-plow blade 20 is preferably made of high-strength steel, since conventional mild steel plow blades do not hold up as well as high-strength steel blades.

The plow blade is attached to a rotator 70, which is in turn attached to the boom 80 of a track-mounted excavator 50 (the excavator 50 being mounted on the first flat-bed rail car 60). A stop (representative example 55 shown in FIGS. 1, 2, 3, and 4) prevents translation or rotation of the excavator 50. Excavator 50 may be any one of a number of excavators, such as a John Deere Model 892D-LC available from John Deere Construction Equipment Division of Deere & Company of Moline, Ill. The normal dipper stick and bucket attachment are removed from the excavator for attachment of a rotator 70 described below to the boom. The excavator is attached to the rail car with several conventional attachments (not shown).

Use of a conventional excavator 50 with a rotator 70 provides a convenient and relatively low-cost way of maneuvering the plow blade into position, and provides weight and down-pressure capability. Since the power of the excavator is limited, the plowing forces occurring during hard plowing conditions overcome the resistance from the excavator. This reduces plow damage. The excavator is easily set up to work on either side of the apparatus without duplication of plow and hydraulic systems for the two sides. For operation that places the plowshare beyond either of the lateral edges alternatively, the hydraulic boom must of course be capable of extending beyond either lateral edge. For such applications, the excavator is preferably centered approximately on the longitudinal axis of the railroad flat car on which it is mounted.

Hydraulic power may be provided by a hydraulic pump 150 driven by a separate generator 120, e.g. a conventional 25 KW generator, or by utilizing the hydraulic system of excavator 50. The plow hydraulic system is preferably modified by installing conventional pressure relief valves (not shown) to prevent excessive forces on the plowing apparatus.

Figure 3:
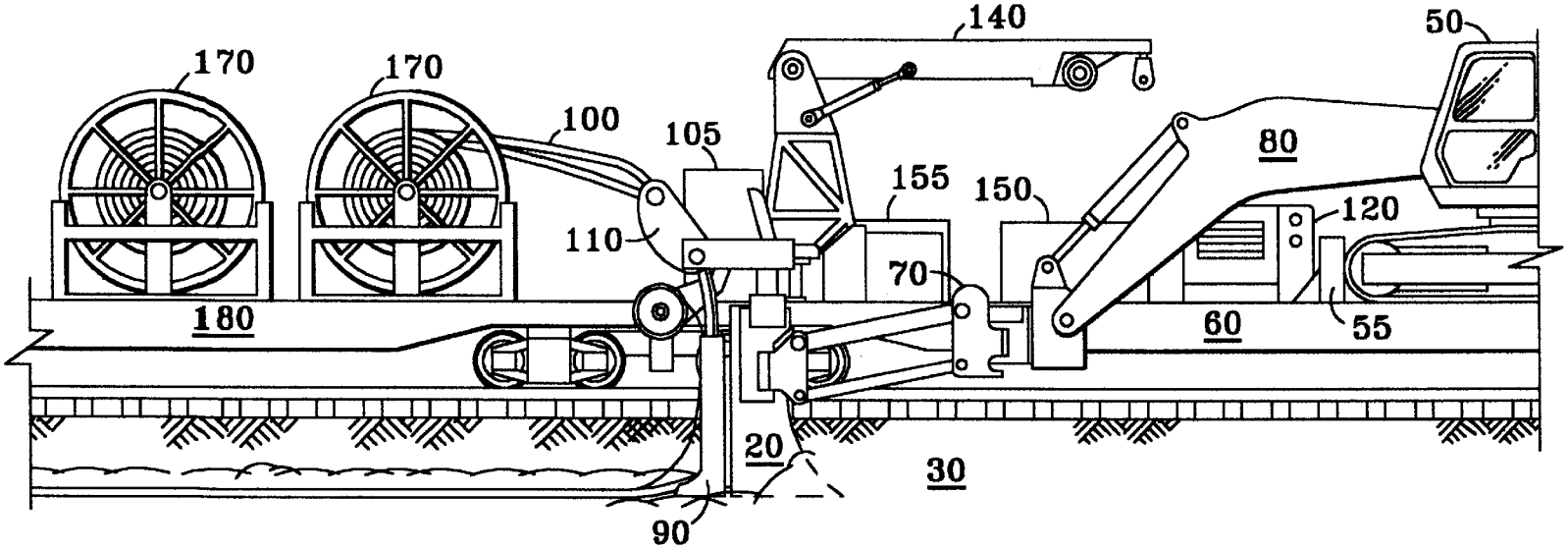
FIG. 3 is a partial side elevation view of a preferred embodiment of a railroad cable plow apparatus.

FIG. 3 is a partial side elevation view of a preferred embodiment of a railroad cable plow apparatus. A second flat-bed rail car 180 for carrying up to six reels 170 of cable or conduit 100 preferably follows the first flat-bed rail car 60, and cable 100 is fed from the second car to the first. Reels 170 may be 2.44 meter diameter by 1.22 meter wide (8 foot diameter by 4 foot wide) steel reels carrying 2.44 kilometers (8,000 feet) of innerduct per reel, for example. Cable guides 110 guide the cable or conduit from the reels to the plowshare and through the plowshare assembly to the desired subterranean level. It will be clear to those skilled in the art that modifications may be made to adapt the reel car, cable guides, and their chute for 10 to 12 innerduct. This second flat-bed rail car 180 may also have safety railing for worker protection, a light tower to provide overall lighting, a fold-down "cat walk" to allow access on the side and to the rear of the reels, a table to view work and plans, and a storage compartment, such as a 6.1 meter by 2.44 meter (20 ft. by 8 ft.) trailer 185. A crane 140, such as a 5.5 ton crane, may be provided on one of the rail cars to provide service to the plow and to load reels 170.

Figure 4:
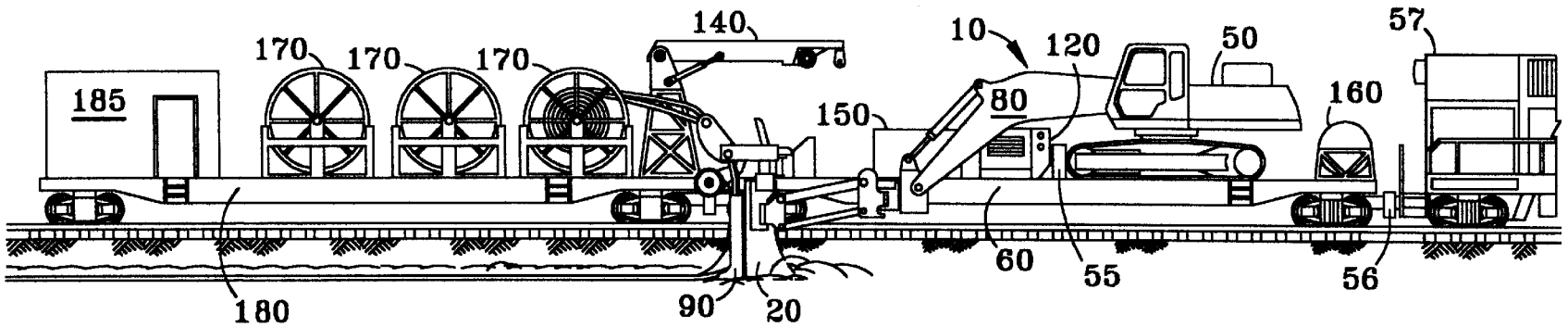
FIG. 4 is another side elevation view of a preferred embodiment of a railroad cable plow apparatus.

The first and second flat-bed cars are preferably pulled by a pair of conventional diesel-electric locomotives 57 (one shown in FIG. 4). The use of two locomotives (up to e.g. 3,000 HP each) provides redundancy in case of breakdown. This redundancy reduces the chance of delaying normal railroad traffic if a locomotive breakdown occurs. The normal locomotive output during plowing is less than about 500 HP. Thus, without redundancy requirements, a single diesel-electric locomotive can easily pull the apparatus while plowing is in progress.

A rigid element 65 (shown in FIGS. 2, 5, 6, and 7) transfers torque on the plowing assembly to the rail car 60. This torque is due to lateral forces resulting from the eccentric position of plowshare 20 relative to the longitudinal axis of rail car 60. Rigid element 65 is preferably removable to temporarily narrow the apparatus 10 for travel mode (i.e. when plowing is not taking place). Removal of rigid element 65 prevents collisions in travel mode. Rigid element 65 preferably has a triangular end piece 71, which bears against rotator 70 (or more preferably against a plate mounted on rotator 70) when the plow blade 20 is disposed at the desired distance laterally from a side edge of rail car 60.

While FIG. 2 shows plow blade 20 disposed alternatively at approximately equal distances laterally from either side edge of rail car 60, boom 80 can be extended to position plow blade 20 at various lateral distances from the rail (up to about 3.7 meters with the excavator model described above). This reach is greater than presently available rail plows, which typically can extend the plow blade only about 1.8 meters from the rail. The improved reach provided by the present invention has great advantage when the plowing encounters structures adjacent to the track, such as switches, switch ties longer than standard rail ties, track lubricator boxes, and other structures. The apparatus of the present invention is also capable of various modifications to reduce the clearance envelope needed to work, i.e., to adapt the apparatus for working within tighter clearance situations.

Figure 6:
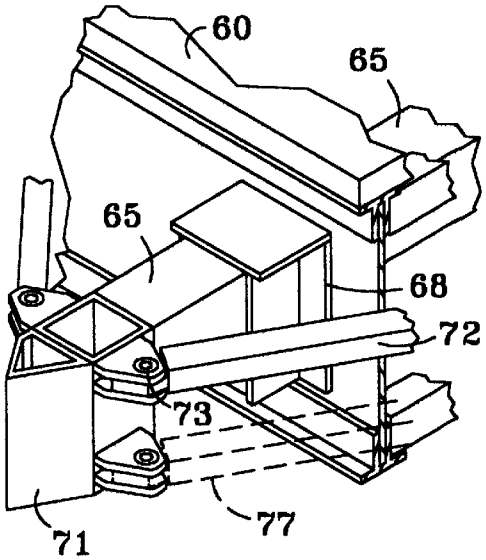
FIG. 6 is a partially cutaway perspective view illustrating a rigid element arranged as in FIG. 5.
Figure 5:
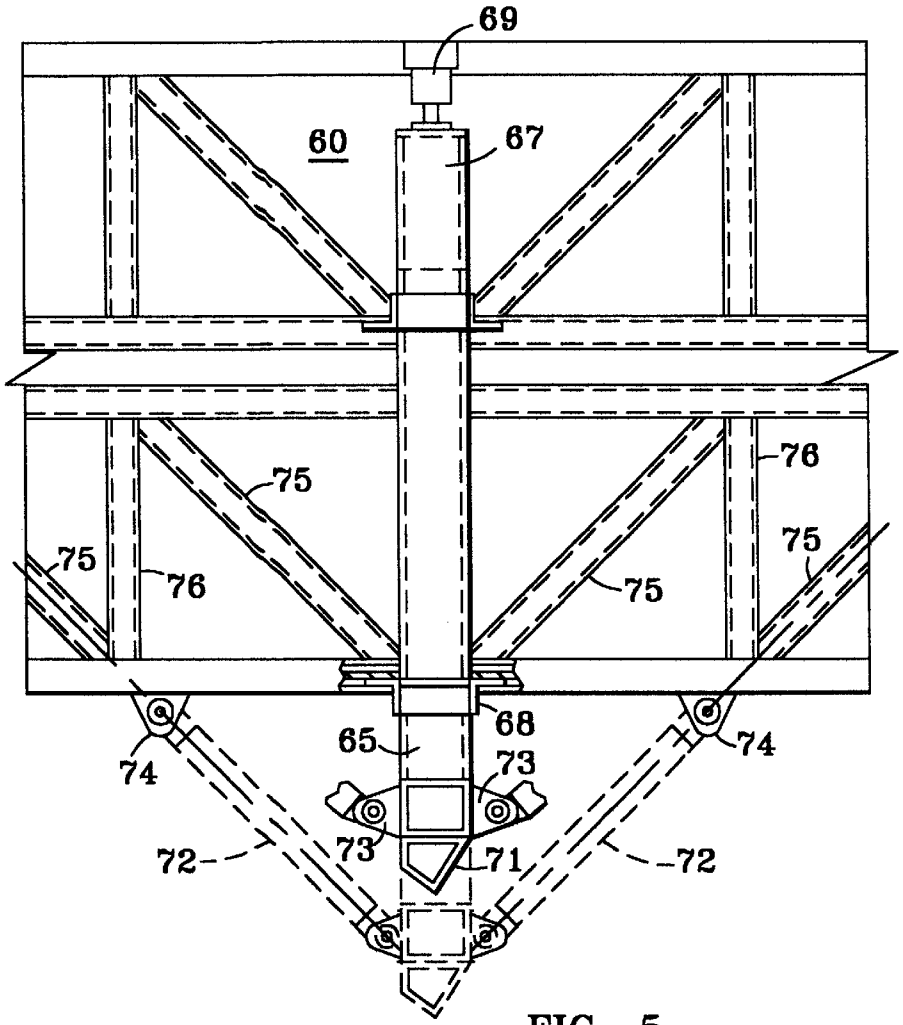
FIG. 5 is a partial bottom plan view illustrating reinforcement framing and an arrangement for removably mounting a rigid element in a railroad cable plow apparatus made in accordance with the invention.

FIGS. 5 and 6 show details of the mounting of rigid element 65. FIG. 5 is a bottom plan view of a portion of rail car 60, showing truss-like reinforcement framing 75 and 76 attached to the bottom flanges of the main girders of the rail car to allow even load transfer to the top and bottom of the girders and to stiffen the unsupported flanges. The top flanges were previously framed together and stiffened as part of the existing framing of the rail car and to support the decking of the rail car. FIG. 5 also shows the mounting of rigid element 65. Rigid element 65 preferably fits within an 8×8 square steel structural tube 67 mounted with right-angle brackets 68 as shown in FIG. 5. The rigid element 65 may be moved into position hydraulically by hydraulic actuator 69 and secured. Knee braces 72 (preferably removable) attached at joints 73 and 74 transfer both longitudinal and lateral forces into the structural components of rail car 60. Joints 74 are preferably disposed so that braces 72 are aligned with diagonal reinforcement framing elements 75, so that the load is transmitted along the external braces 72 and along a straight-line path to diagonal reinforcement framing elements 75. This preferred alignment of braces 72 and diagonal reinforcement framing elements 75 is also shown in FIG. 7.

Figure 7:
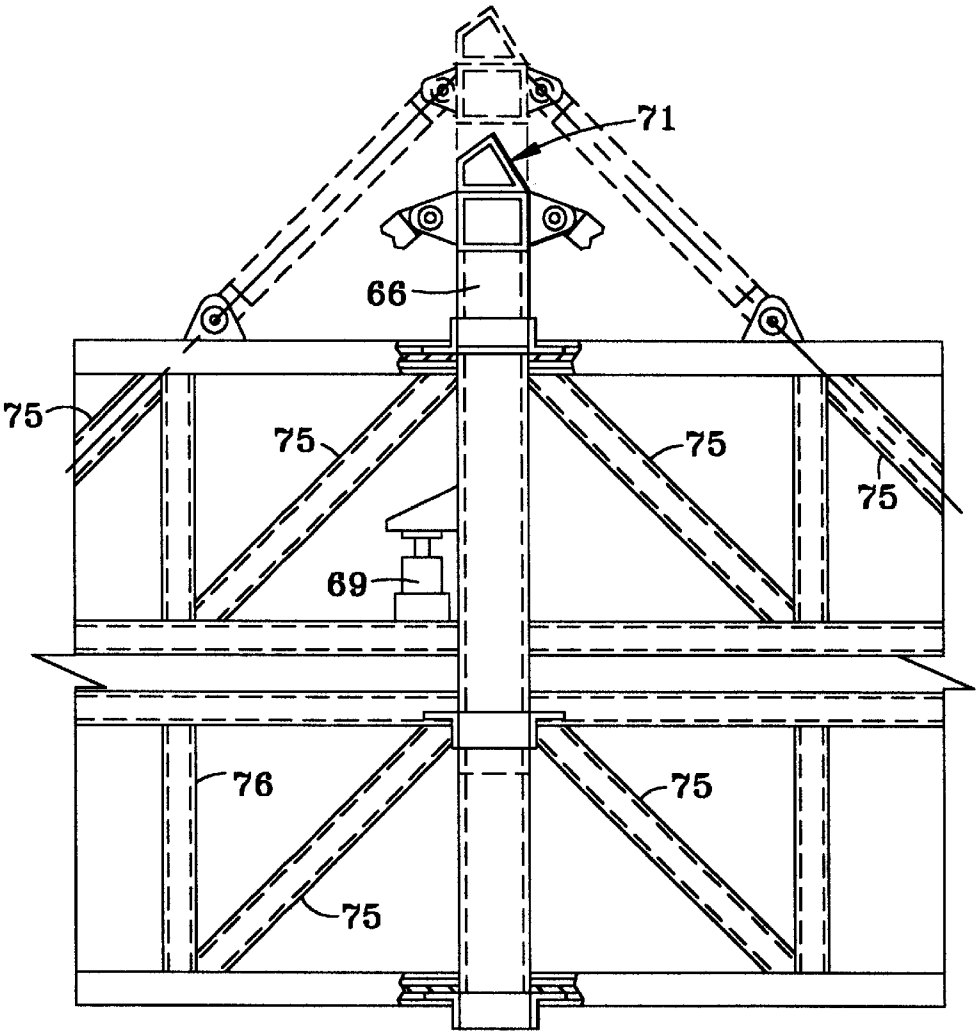
FIG. 7 is a partial bottom plan view illustrating an arrangement for mounting a rigid element for operation on either side of a flat-bed railroad car.

FIG. 7 shows an arrangement whereby the 8×8 square steel structural tube may extend from one edge of rail car 60 to the other, and rigid element 66 may be extended outward from either edge (or at both edges) of rail car 60. Rigid element 66 is made similarly to rigid element 65 of FIGS. 5 and 6, except for being long enough to extend at either side of the rail car and having an end piece 71 at both ends. Hydraulic actuator 69 may be disposed to one side of rigid element 66 for positioning rigid element 66.

Figure 11:
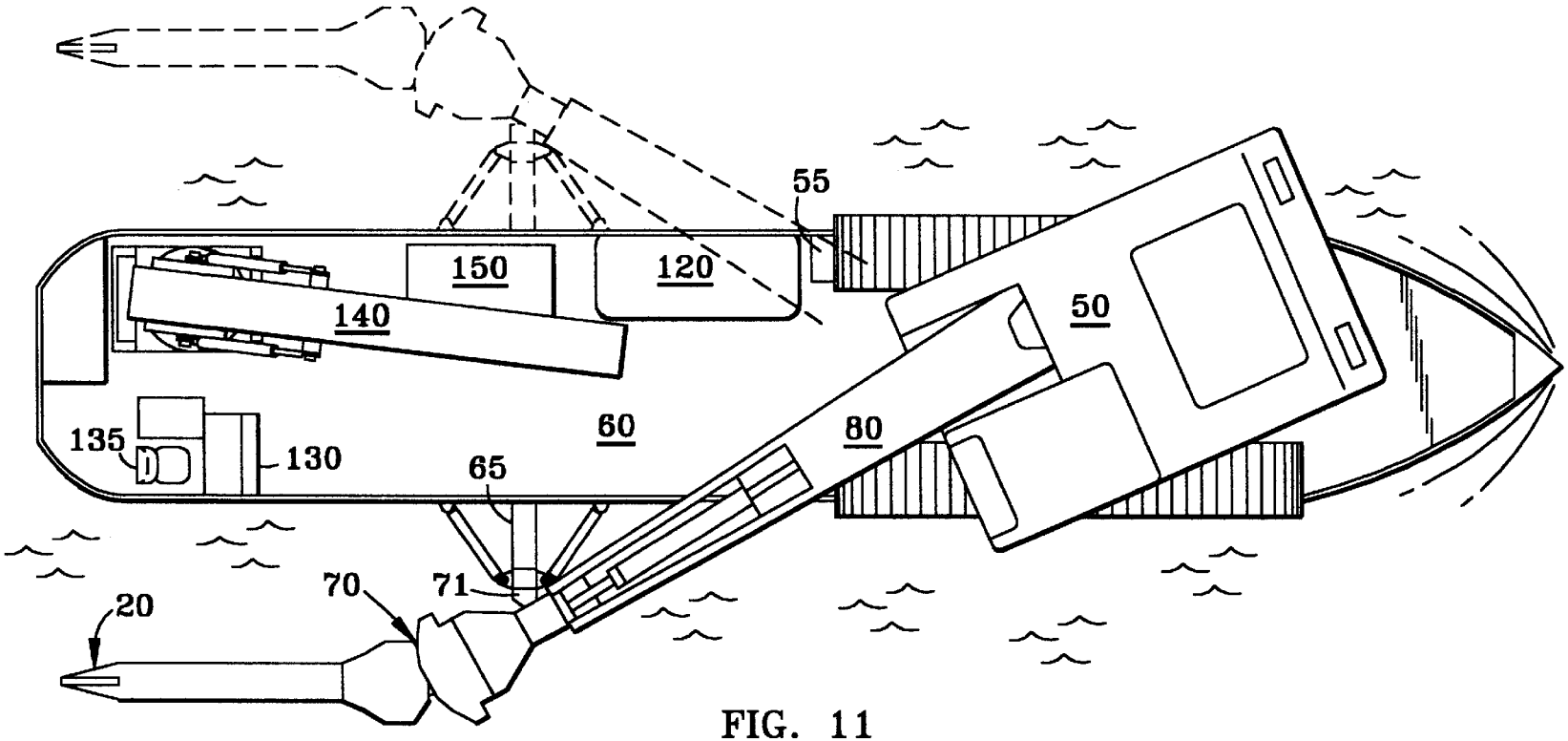
FIG. 11 is a top plan view of a cable plow apparatus embodiment utilizing a barge.

The apparatus may be installed on a flat-bed truck or on a canal barge instead of a rail car. A version utilizing a flat-bed truck can be used to install cable alongside the road. A version utilizing a canal barge can be used to install cable along a tow path of a canal, for example. A version utilizing a barge 500 is shown in FIG. 11.

A second plow, mounted on a third flat-bed car spaced ahead of the main plow, can pre-rip the ground ahead of the main plow. This pre-ripping plow is useful when tough plowing areas are encountered. The pre-ripping ("lead") plow prepares the ground so that plowing to the specified depth can be more easily accomplished. The lead plow for pre-ripping is mounted on a separate railroad flat-bed car similar to rail cars 50 and 60 disposed one or two cars ahead of the main plowing car 60. The lead plow and locomotive can be uncoupled temporarily from the main plowing car 60 when necessary so that several passes can be made with the pre-ripping plow to minimize interruptions to the plowing.

Figure 8:
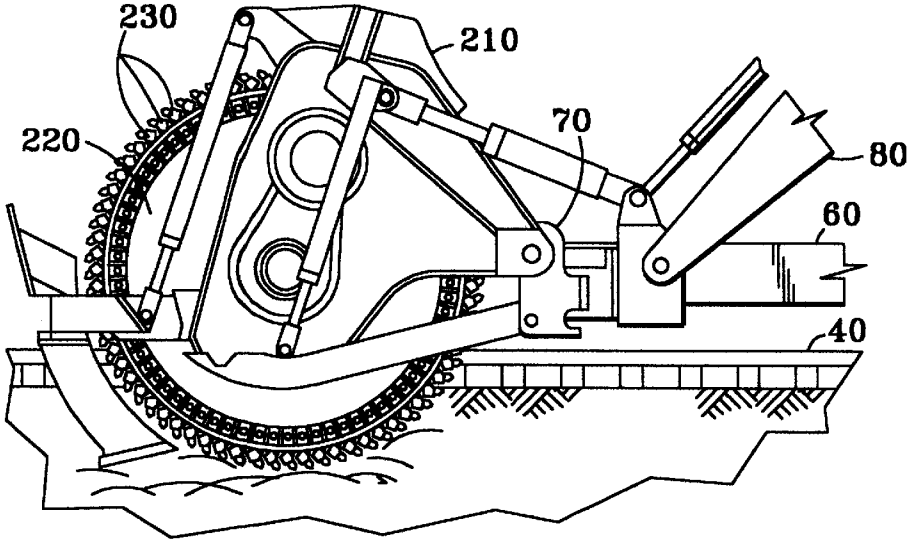
FIG. 8 is a partial side elevation view of a railroad cable plow apparatus including a wheel-shaped rocksaw.

The plow blade 20 is readily equipped with a conventional vibratory attachment and/or replaced for specific purposes with a soil trencher, rock chainsaw, wheel rocksaw, or other type of end-effector. (The term "end-effector" refers to any implement or tool, mounted to the end of boom 80 or rotator 70, and useful in laying cable or preparing the right-of-way for the cable installation.) The replacement of plow blade 20 may of course be temporary. FIG. 8 shows a partial side elevation view of a railroad cable plow apparatus including a wheel-shaped rocksaw 210 mounted to rotator 70 in place of plow blade 20. Rocksaw 210 has a wheel 220 having carbide teeth 230. Those of ordinary skill will recognize that such a rocksaw 210 can be mounted directly to boom 80 without a rotator 70 if desired. A suitable rocksaw 210 is a wheel rocksaw optionally provided with Models TRS-900SL, TRS-1000, or TRS-1075 available from Tesmec USA, Inc. of Alvarado, Tex., which can cut trenches nominally 10 cm–25 cm wide at various cutter wheel speeds infinitely variable between zero and about 640 meters/minute.

Figure 9:
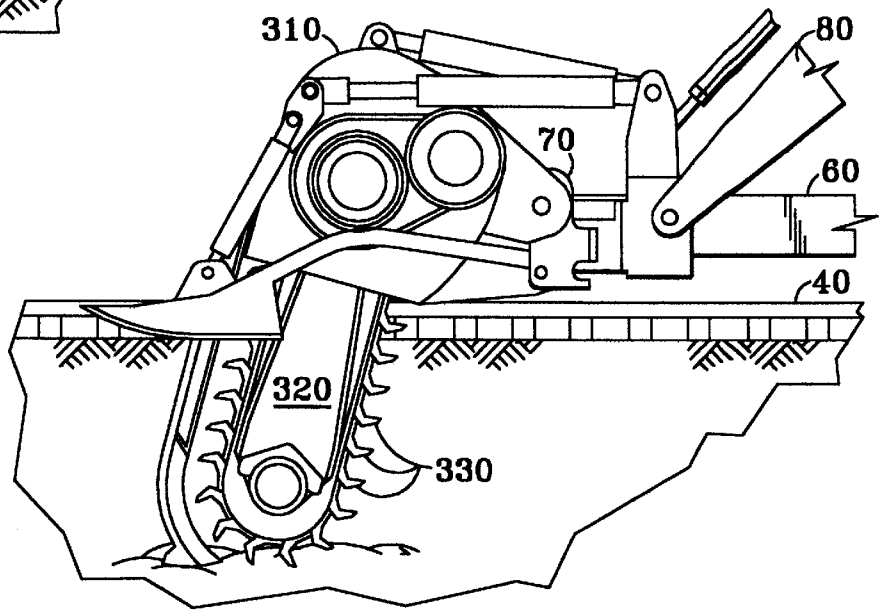
FIG. 9 is a partial side elevation view of a railroad cable plow apparatus including a soil trencher.

FIG. 9 shows a partial side elevation view of a railroad cable plow apparatus including a soil trencher 310 mounted in a manner similar to the rocksaw of FIG. 8. Soil trencher 310 has a "chainsaw" type of blade 320 with teeth 330 shaped for scooping dirt out of the ground to form a trench. A suitable soil trencher 310 is the Model 617 trencher available from Bradco Division of ATI Global, Inc. of Delhi, Ohio. That trencher is equipped with a head-shaft-driven spoil auger, and can cut trenches nominally 15 cm–30 cm wide.

Figure 10:
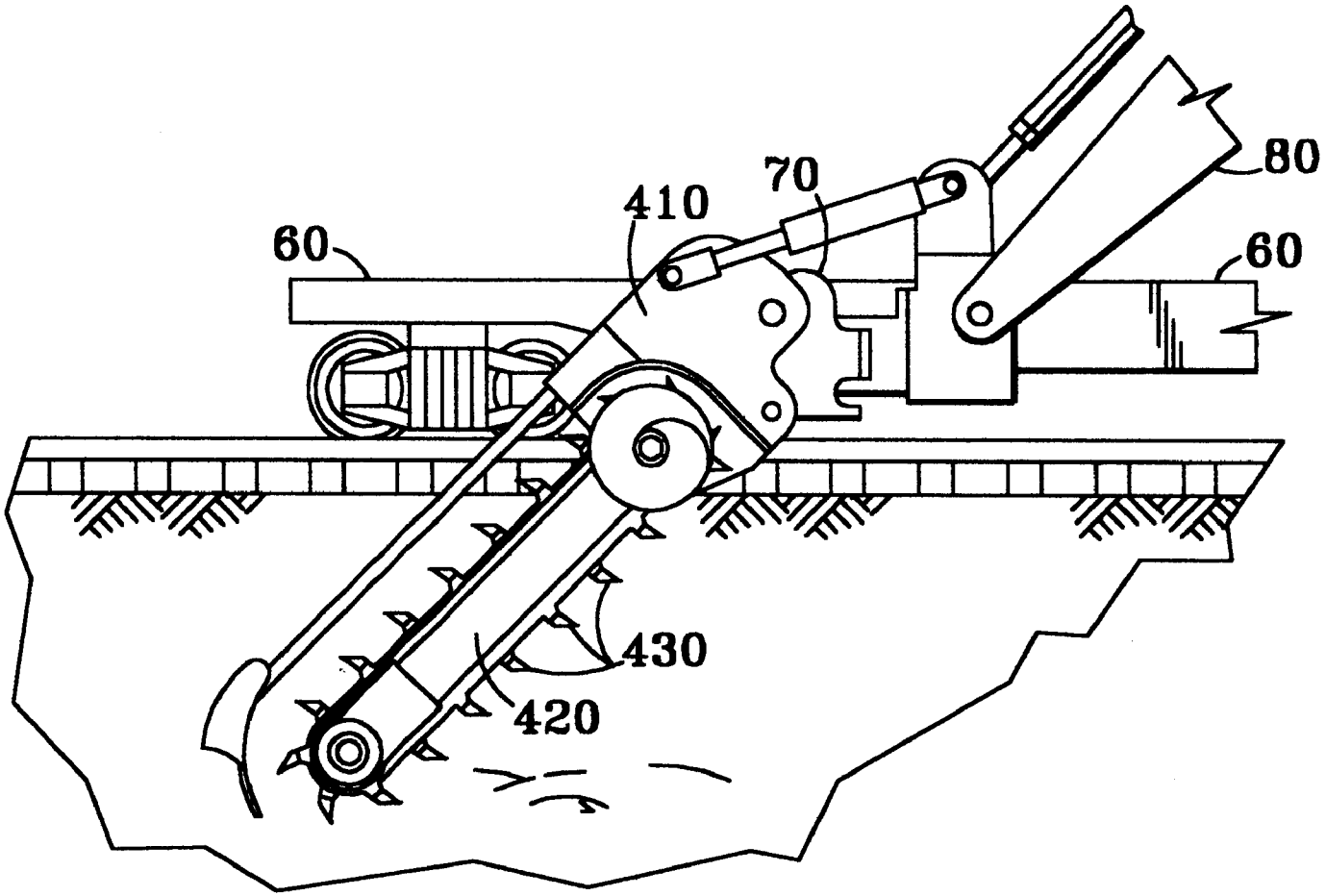
FIG. 10 is a partial side elevation view of a railroad cable plow apparatus including a rock chainsaw.

FIG. 10 shows a partial side elevation view of a railroad cable plow apparatus including a rock chainsaw 410 mounted in a manner similar to the wheel rocksaw 210 of FIG. 8 or the soil trencher 310 of FIG. 9. Rock chainsaw 410 has a "chainsaw" type of blade 420 with carbide teeth 430. A suitable rock chainsaw 410 is a rock chainsaw optionally provided with Models TRS-900SL, TRS-1000, or TRS-1075 available from Tesmec USA, Inc. of Alvarado, Tex.

Industrial Applicability

The apparatus is useful for installing underground all kinds of elongate articles, including conventional utility cables (for e.g. electric power, telecommunications, data transmission, etc.) including particularly fiber-optic cable, and conduits (such as innerduct) through which cables, wires, and fiber-optics are conventionally fed.

In using the apparatus to install cable, such as fiber-optic communication cables and the like, it is necessary to bury the cables below the ground surface by at least one meter (at least 1.3 meters preferred), and preferably 1.5 to 3 meters away from the track and ballast. Normally, innerduct is installed first and then fiber-optic element pulled through afterward to minimize cable splices. Some conduits may be left empty for future use. More than one innerduct can be installed simultaneously, along with a marking tape. As mentioned above, the reel car, cable guides, and their chute may be adapted for 10 to 12 innerduct.

The excavator is slightly rotated when the plow is in working position. This can disturb an area about 1.3 meters beyond the rail car envelope, only at a height of about 2 to 3.3 meters above the rail. The excavator may be modified, or a different excavator may be selected, to reduce the disturbed area.

The present apparatus is capable of installing cable at a rate of up to about 50 meters per minute in soft soil conditions. Installation in hard ground conditions is about 3 meters per minute. Production of installed cable is occasionally interrupted for locations where the innerduct is cut for road crossings, utility crossings, bridges, handhold structures and splice manholes; for exceptionally difficult plowing conditions; for low clearance locations such as rock cuts, railroad control structures such as switch stands, or retaining walls; or for splicing of the innerduct. Couplings used at splices may be made in sizes that allow them to be installed through the plow's cable chute. These limitations are common to all types of plowing apparatus. Experimental operation of apparatus made in accordance with the invention resulted in successful plowing efficiency of 84% of the desired cable length at the desired depth overall, and of 94% after taking into account those areas where plowing was not allowed, such as bridges, road crossings, and culverts. The remaining 6% consisted of rock, boulders, and low clearance areas.

To minimize impact on normal railroad operations, it is desirable to perform most of the plowing operations at night. A generator and 4,000 watt output light tower are preferably installed to provide light for such nighttime operations. Welding equipment and torches may be carried to allow field repairs if necessary. A 250-gallon water tank 160 is preferably installed to provide fire protection during field welding and for cleaning the plowshare blade. Such plowshare blade cleaning is required in certain wetland conditions. A clean-up backhoe may work behind the rail plow operation. Such clean-up effort is generally light except when obstructions are encountered during plowing.

Other embodiments of the invention will be apparent to those skilled in the art from a consideration of this specification or from practice of the invention disclosed herein. For example, if the apparatus uses a canal barge instead of a rail car for cable installation along a canal, two vehicles such as front-end loaders, e.g. one on either side of a canal, connected to the barge with cables may be used to tow and guide the barge. For another example, some dimensions may be enlarged to allow the installation of larger conduit (e.g. 101 mm ID), which can contain a number of smaller-diameter conduits (e.g. 32 mm ID) within it. It is intended that the specification and examples be considered as exemplary only, with the true scope and spirit of the invention being defined by the following claims. Having described our invention, we claim:

What is claimed is:

1. An apparatus for installing underground cable, conduit, or innerduct, said apparatus comprising:

a) a flat-bed first vehicle having lateral edges, b) a second vehicle secured to said flat-bed first vehicle, said second vehicle including a hydraulic boom capable of extending beyond at least one of said lateral edges of said flat-bed first vehicle, c) a plowshare connected to said hydraulic boom for digging a trench, and d) means for feeding said cable, conduit, or innerduct to said plowshare, said flat-bed first vehicle being equipped with a rigid element disposed to extend laterally from said flat-bed first vehicle to maintain said plowshare at a distance from said at least one lateral edge of said first vehicle to guide said plowshare for installing said cable, conduit, or innerduct, and to transfer torque from said plowshare to said first vehicle.

2. An apparatus as recited in claim 1, wherein said flat-bed first vehicle is a railroad car for digging said trench and installing said cable, conduit, or innerduct substantially parallel to railroad tracks.

3. An apparatus as recited in claim 2, wherein said railroad car is coupled to a rail locomotive.

4. An apparatus as recited in claim 3, wherein said railroad car is pulled by said rail locomotive.

5. An apparatus as recited in claim 1, further comprising a third vehicle for carrying at least one reel of said cable, conduit, or innerduct, said means for feeding being disposed to accept cable, conduit, or innerduct supplied from said at least one reel.

6. An apparatus as recited in claim 5, wherein said third vehicle has sufficient capacity for carrying up to six reels of said cable, conduit, or innerduct.

7. An apparatus as recited in claim 5, wherein said third vehicle comprises a second railroad car.

8. An apparatus as recited in claim 7, wherein said third vehicle is coupled to said flat-bed first vehicle.

9. An apparatus as recited in claim 7, wherein said third vehicle is disposed behind said flat-bed first vehicle while said flat-bed first vehicle is pulled by a rail locomotive.

10. An apparatus as recited in claim 1, further comprising pivotable attachment means for connecting said plowshare pivotably to said hydraulic boom.

11. An apparatus as recited in claim 10, further comprising a hydraulic pump for actuating said pivotable attachment means.

12. An apparatus as recited in claim 10, wherein said pivotable attachment means is pivotable around a horizontal axis.

13. An apparatus as recited in claim 10, wherein said pivotable attachment means is pivotable around a vertical axis.

14. An apparatus as recited in claim 10, wherein said pivotable attachment means is pivotable around an axis parallel to said hydraulic boom.

15. An apparatus as recited in claim 10, wherein said pivotable attachment means is pivotable around an axis perpendicular to said hydraulic boom.

16. An apparatus as recited in claim 1, wherein said second vehicle is a commercial tracked excavator.

17. An apparatus as recited in claim 16, wherein said commercial tracked excavator includes hydraulic means for powering at least said hydraulic boom.

18. An apparatus as recited in claim 1, wherein said hydraulic boom is capable of extending to dispose said plowshare alternatively beyond either of said lateral edges of said flat-bed first vehicle.

19. An apparatus as recited in claim 1, wherein said rigid element is disposed to extend laterally beyond either of said lateral edges of said flat-bed first vehicle.

20. An apparatus as recited in claim 1, wherein said rigid element comprises a triangular end piece disposed to maintain said plowshare at a desired distance.

21. An apparatus as recited in claim 1, wherein said rigid element is disposed to extend laterally beyond both of said lateral edges of said flat-bed first vehicle.

22. An apparatus as recited in claim 1, wherein said rigid element is removably attached to said flat-bed first vehicle to be removable for travel.

23. An apparatus as recited in claim 1, further comprising powered means for moving said rigid element laterally inward or outward with respect to said flat-bed first vehicle.

24. An apparatus as recited in claim 23, wherein said powered means for moving is hydraulically actuated.

25. An apparatus as recited in claim 1, wherein said rigid element is movable laterally with respect to said flat-bed first vehicle between at least a first position extending beyond one of said lateral edges of said flat-bed first vehicle and a second position extending beyond the other of said lateral edges.

26. An apparatus as recited in claim 1, farther comprising a hydraulic pump for actuating said hydraulic boom.

27. An apparatus as recited in claim 1, wherein said flat-bed first vehicle is a flat-bed truck trailer.

28. An apparatus as recited in claim 1, wherein said flat-bed first vehicle is a barge.

29. An apparatus as recited in claim 1, further comprising:

a third vehicle disposed to precede said flat-bed first vehicle, said third vehicle including means for preparing ground for digging said trench for installing said underground cable, conduit, or innerduct.

30. An apparatus for installing underground cable, conduit, or innerduct alongside railroad tracks, said apparatus comprising:

a) a flat-bed railroad car having lateral edges, b) a tracked excavator secured to said flat-bed first vehicle, said tracked excavator including a hydraulic boom capable of extending beyond at least one of said lateral edges of said flat-bed railroad car, c) a plowshare connected to said hydraulic boom for digging a trench substantially parallel to said railroad tracks, and d) means for feeding said cable, conduit, or innerduct to said plowshare, said flat-bed railroad car being equipped with a rigid element disposed to extend laterally from said flat-bed railroad car to maintain said plowshare at a distance from said railroad tracks and from said at least one lateral edge of said railroad car to guide said plowshare for installing said cable, conduit, or innerduct, and to transfer torque from said plowshare to said flat-bed railroad car.

31. An apparatus for installing underground cable, conduit, or innerduct alongside railroad tracks, said apparatus comprising:

a) a flat-bed first railroad car having lateral edges, b) a tracked excavator secured to said flat-bed first railroad car, said tracked excavator including a hydraulic boom capable of extending beyond at least one of said lateral edges of said flat-bed first railroad car, c) a plowshare pivotably connected to said hydraulic boom for digging a trench substantially parallel to said railroad tracks, d) a rotator disposed between said hydraulic boom and said plowshare for providing a pivotable connection and for pivoting said plowshare, e) a second railroad car for carrying supply reels of cable, conduit, or innerduct to be installed, and f) means for feeding said cable, conduit, or innerduct from said supply reels to said plowshare, said flat-bed first railroad car being equipped with a rigid element removably attached to said flat-bed first railroad car, said rigid element being disposed to extend laterally from said flat-bed first railroad car, and said rigid element including at least one triangular end piece disposed to maintain said plowshare at a distance from said railroad tracks and from said at least one lateral edge of said flat-bed first railroad car to guide said plowshare for installing said cable, conduit, or innerduct, and to transfer torque from said plowshare to said flat-bed first railroad car.

32. An apparatus as recited in claim 31, further comprising:

a third railroad car disposed to precede said flat-bed first railroad car, said third railroad car including means for preparing ground for digging said trench for installing said underground cable, conduit, or innerduct.

33. An apparatus as recited in claim 32, wherein said means for preparing ground is a second plowshare.

34. An apparatus as recited in claim 31, wherein said plowshare is removable, and said plowshare is replaceable by an end-effector consisting of at least one of a soil trencher, rock chainsaw, and wheel rocksaw.

35. An apparatus for installing underground cable, conduit, or innerduct, said apparatus comprising:

a) a flat-bed first vehicle having lateral edges, b) a second vehicle secured to said flat-bed first vehicle, said second vehicle including a hydraulic boom capable of extending beyond at least one of said lateral edges of said flat-bed first vehicle, c) a plowshare connected to said hydraulic boom for digging a trench, and d) means for feeding said cable, conduit, or innerduct to said plowshare, said flat-bed first vehicle being equipped with a rigid element disposed to extend laterally from said flat-bed first vehicle to maintain said plowshare at a distance from said at least one lateral edge of said first vehicle to guide said plowshare for installing said cable, conduit, or innerduct, and to transfer torque from said plowshare to said first vehicle, said rigid element being constrained from rotation about any axis relative to said flat-bed first vehicle.

36. An apparatus for installing underground cable, conduit, or innerduct, said apparatus comprising:

a) a flat-bed first vehicle having lateral edges, b) a second vehicle secured to said flat-bed first vehicle, said second vehicle including a hydraulic boom capable of extending beyond at least one of said lateral edges of said flat-bed first vehicle, c) a plowshare connected to said hydraulic boom for digging a trench, and d) means for feeding said cable, conduit, or innerduct to said plowshare, said flat-bed first vehicle being equipped with a rigid element disposed to extend laterally from said flat-bed first vehicle to maintain said plowshare at a distance from said at least one lateral edge of said first vehicle to guide said plowshare for installing said cable, conduit, or innerduct, said rigid element further comprising a triangular end piece disposed to maintain said plowshare at a desired distance.

37. An apparatus for installing underground cable, conduit, or innerduct, said apparatus comprising:

a) a flat-bed first vehicle having lateral edges, b) a second vehicle secured to said flat-bed first vehicle, said second vehicle including a hydraulic boom capable of extending beyond at least one of said lateral edges of said flat-bed first vehicle, c) a plowshare connected to said hydraulic boom for digging a trench, and d) means for feeding said cable, conduit, or innerduct to said plowshare, said flat-bed first vehicle being equipped with a rigid element disposed to extend laterally from said flat-bed first vehicle to maintain said plowshare at a distance from said at least one lateral edge of said first vehicle to guide said plowshare for installing said cable, conduit, or innerduct, said rigid element being movable laterally with respect to said flat-bed first vehicle between at least a first position extending beyond one of said lateral edges of said flat-bed first vehicle and a second position extending beyond the other of said lateral edges.

38. An apparatus for installing underground cable, conduit, or innerduct, said apparatus comprising:

a) a flat-bed first vehicle having lateral edges, said flat bed first vehicle being a barge, b) a second vehicle secured to said flat-bed first vehicle, said second vehicle including a hydraulic boom capable of extending beyond at least one of said lateral edges of said flat-bed first vehicle, c) a plowshare connected to said hydraulic boom for digging a trench, and d) means for feeding said cable, conduit, or innerduct to said plowshare, said flat-bed first vehicle being equipped with a rigid element disposed to extend laterally from said flat-bed first vehicle to maintain said plowshare at a distance from said at least one lateral edge of said first vehicle to guide said plowshare for installing said cable, conduit, or innerduct.

39. An apparatus for installing underground cable, conduit, or innerduct, said apparatus comprising:

a) a flat-bed first vehicle having lateral edges, b) a second vehicle secured to said flat-bed first vehicle, said second vehicle including a hydraulic boom capable of extending beyond at least one of said lateral edges of said flat-bed first vehicle, c) a plowshare connected to said hydraulic boom for digging a trench, d) means for feeding said cable, conduit, or the like to said plowshare, said flat-bed first vehicle being equipped with a rigid element disposed to extend laterally from said flat-bed first vehicle to maintain said plowshare at a distance from said at least one lateral edge of said first vehicle to guide said plowshare for installing said cable, conduit, or innerduct, and e) a third vehicle disposed to precede said flat-bed first vehicle, said third vehicle including means for preparing ground for digging said trench for installing said underground cable, conduit, or innerduct.

* * * * *